United States Patent [19]

Feres

[11] 4,171,182

[45] Oct. 16, 1979

[54] EXTRACTOR PUMP FOR FLUIDS UNDER VACUUM

[76] Inventor: Václav Feres, Haid-Neustrasse 14, 7500 Karlsruhel, Fed. Rep. of Germany

[21] Appl. No.: 903,611

[22] Filed: May 8, 1978

[51] Int. Cl.[2] ..... F01D 1/36

[52] U.S. Cl. ..... 415/90

[58] Field of Search ..... 233/1 R, 3, 19 R, 27, 233/28, 46; 415/90

[56] References Cited

U.S. PATENT DOCUMENTS

| | | | |
|---|---|---|---|
| 2,276,824 | 3/1942 | Carruthers | 415/90 |
| 3,007,311 | 11/1961 | Amero | 415/90 X |

FOREIGN PATENT DOCUMENTS

| | | | |
|---|---|---|---|
| 224711 | 3/1943 | Switzerland | 233/32 |

*Primary Examiner*—George H. Krizmanich

*Attorney, Agent, or Firm*—Craig and Antonelli

[57] ABSTRACT

A pump for extracting fluids from a vacuum enclosure with the pump including a housing having an impeller rotating therein in sealed relationship therewith. Fluid passes through a feed tube to the center of the impeller with a plurality of delivery channels extending radially of the impeller and being in fluid flow connection with the center of the impeller. The delivery channels are of assymetric U-shaped or analagous form within which, in use, the fluid forms a barrier between the high and low pressure environments.

15 Claims, 9 Drawing Figures

EXTRACTOR PUMP FOR FLUIDS UNDER VACUUM

The invention is concerned with a pump for the extraction of fluids from a vacuum enclosure into an enclosure at a higher pressure, the pump having a housing with a substantially tangentially disposed pressure tube or outlet, a wheel or impeller disc which rotates in the housing, and to which the fluid is fed through a feed tube in an axial direction, and fluid transporting means situated on the wheel, or impeller disc for transporting fluid from the feed tube to the pressure outlet.

Extraction of fluid from vacuum enclosures into enclosures which are at higher pressures plays a significant role especially in chemical processing industry. Many processes take place only in a vacuum. If these processes are carried out continuously, provision must also be made for continuous extraction of the fluid; in most cases extraction takes place against atmospheric pressure. Special difficulties arise if the fluid to be extracted is at boiling point, and therefore contains bubbles of vapour.

If the usual forms of fluid pump are used for such purposes, provision must be made for a feed height which will balance the pressure difference.

In order to reduce this large feed height, fluid ring pumps are used. In this case there is a ring of fluid around the wheel which provides a permanent seal between the enclosure at low pressure and the enclosure at high pressure. To the wheel which generates this fluid ring, there are attached one or more paddle wheels, which provide the actual propulsion. Since the fluid ring rotates with the wheel, the fluid becomes heated through friction, with the consequence that the rate of exhaustion increases, especially if the fluid is initially nearly at its boiling point. In addition, formation of bubbles of vapour and of gas leads to undesirable cavitation. The fluid removed must be replaced by fresh fluid and the fluid ring must be cooled by bringing in of the fluid being moved, with the consequence that these pumps always require a not inconsiderable minimum quantity of material. The pumps also require a definite feed height of more than 0.5 m. Finally, these pumps are not suitable for use in the high vacuum region (from a few Torr to about $10^{-2}$ Torr).

In addition, displacement pumps or what are called positive pumps, e.g. toothed wheel pumps, spiral pumps (monopumps), thrust pumps (disc pumps) or the like are known to be used for the purpose indicated. In these cases also, a substantial minimum quantity of material is necessary for a fixed feed height, since otherwise air penetrates due to leaks at the joints. None of these pumps can be operated dry. For this reason these pumps also need a control drive or an adjustment of level for control of the quantity of material being moved, and in addition, reverse valves on the pressure side. Nevertheless, these pumps have the advantage that they can also be used for high vacua, where their life is of course satisfactory only if the fluid being propelled has lubricating properties.

For viscous liquids and thick suspensions, locks are also provided, which do not however have any propulsive effect.

The aim of the invention is the production of an extraction pump for use on fluids under vacuum, in which the quantity of material moved is automatically and reliably adapted to the quantity arriving and which maintains the static pressure difference at zero feed quantity, and which propels boiling liquids and liquids containing gases continuously without any feed height and without cavitation.

This aim is fulfulled in a pump of the kind to which the invention relates by ensuring that each fluid transporting means includes a siphon connected in an airtight manner with the suction space of the impeller disc and has a transport channel in which the fluid is led outwardly and then inwardly of the disc to an exit opening, the suction space of the impeller disc being connected with the gas cushion of the vacuum enclosure and being in sealed relationship with respect to the non-rotating parts of the pump housing.

The siphon-like shape of each individual rotating transport channel ensures that the axially moving fluid is accumulated in the region of the guide tube in a similar manner to a U-tube with unequal arms, such that a definite height of fluid is set up in one section of the transport channel—comparable with the longer arm of the U-tube. In the other section of the transport channel—comparable with the shorter arm of the U-tube—the fluid runs away, so that the difference in height between the discharge edge and the accumulated liquid in the other section of the transport channel alters on the one hand the pressure difference between the vacuum space and on the other hand the high pressure space to which the fluid passes. The quantity of material arriving can be minimal, and in particular transport is possible practically in the form of droplets. Since the fluid is placed under pressure by rotation outwards in a practically isolated transport channel which is only over the exit openings leading to the housing, there is a pressure increase in a radial direction, with the consequence that any vapour bubbles present in the fluid are condensed and gas bubbles are absorbed. This leads to avoidance of the cavitation which is to be feared.

In addition, the pump in accordance with the invention has the advantage that there is no encircling water ring, which could lead to heating and hence to higher rates of exhaustion and de-gassing. The pump is suitable for both low and high vacuum use. For starting up, the pump only needs to be half full, since then the transport channels fill up automatically from the suction side. The pump then adapts itself automatically to any subsequent desired quantity of flow.

In accordance with a preferred aspect of the invention each transport channel consists of a tubular component arranged approximately radially to the wheel, and a cup-shaped component over the opening of this tube. This form is particularly simple to manufacture and to use, and is therefore sure in operation. In comparison with thrust pumps, this pump has the substantial advantage that no problems of airtightness arise, and hence that the necessary close manufacturing tolerances for the thrust pump are not required.

When the pump is to be used for extraction of fluids which contain solid particles, the invention provides that the transport channels are provided with an opening with a small clearance, which can be closed when required, in the region of their vertices which encircle the wall of the pump housing and guide the fluid. Due to centrifugal force the solid particles in the fluid accumulate in the region of the reversal locations, and can leave through the small openings into the housing space. The clearance is so chosen that the fluid located near to the reversal location does not escape. The openings can also be closable, so that they are only opened from time to time when the solid particles are small.

The invention will now be described further, by way of example only, with reference to the accompanying drawings in which.

Figure 1:
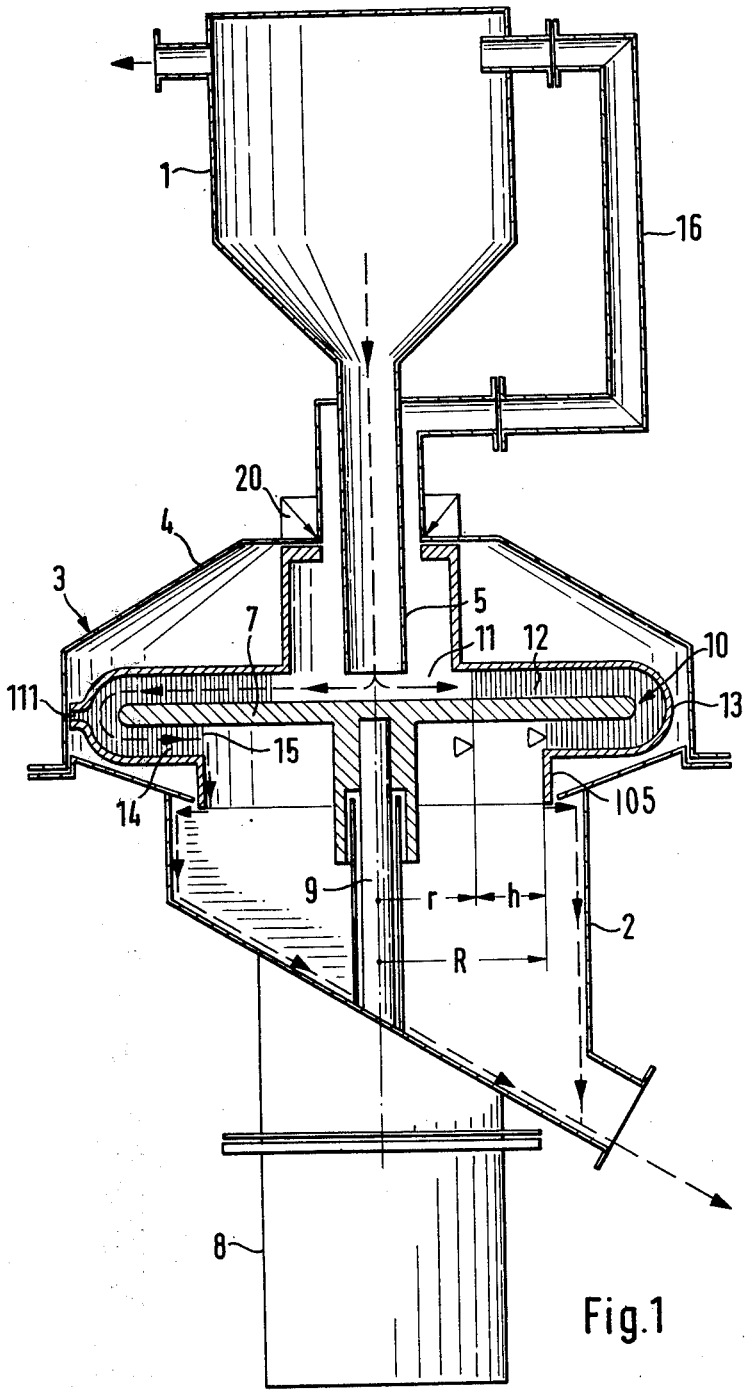
FIG. 1 is a diagram illustrating the working principle of the pump.

Referring now to the drawings, and, more particularly to FIG. 1, according to this figure, a vacuum enclosure 1 and an enclosure 2 at a higher, for example, atmospheric pressure. Enclosure 1 can, for example, be a vacuum evaporator or the like. The complete extractor pump generally designated by the reference numeral 3 is arranged between the vacuum enclosure 1 and the enclosure 2. The extractor pump 3 has a housing 4 with a feed tube 5 and a schematically represented pressure tube or outlet 6 which, in the practical embodiments discussed hereinbelow, extends substantially tangentially of the housing 4. In addition, the pump 3 has an impeller disc or wheel 7, which is rotated by a shaft 9 driven by a motor 8. The impeller disc 7, together with its suction or feed space 11, is made airtight with respect to nonrotating parts of the housing 4 by means of a seal generally designated by the reference numeral 20. The impeller disc or wheel 7 has a number of transport channels generally designated by the reference numeral 10 which extend to the periphery of the impeller disc 7 with each of the channels 10, in principle, being constructed in the form of a U-tube. The channels 10 function to transport or convey fluid from the suction space 11 to the pressure tube or outlet 6. The channels 10 have a section 12 extending outwardly from the suction space 11 of the impeller disc 7, a bend or reversing section 13 at the periphery of the impeller disc 7 and finally an inwardly directed section 14 with the section 14 terminating in an exit opening 15.

On rotation of the impeller disc 7, fluid contained in the vacuum enclosure 1 moves through the feed tube 5 to the suction space 11 and due to centrifugal acceleration, such fluid is pressed into the section 12 of the transport channel 10. A column of fluid is then built up in each transport channel 10 in accordance with the principle of communicating tubes, the fluid accumulation in section 14 of the transport channel 10 being determined by the exit opening 15, while the fluid accumulation in section 12 of the transport channel 10 is set to a different value according to the pressure difference (R−r) between enclosure 1 and enclosure 2. This difference (R−r) in accumulation of fluid is indicated by the reference character h in the drawing. It is ensured in all cases that there is always a fluid barrier in transport channel 10, so that no air can enter. A particularly even and reliable continuous transport is attained when the suction space 11 is connected with the gas cushion of vacuum enclosure 1 by means of a connector 16, so that the pressure is the same in the enclosure 1 and suction space 11.

The reference numerals used in FIG. 1 for the essential parts of the pump are adopted in the following description of some practical embodiments of the invention and in related figures of the drawings. In the embodiment shown in FIGS. 2 and 3, the pressure tube or outlet 6 extends substantially tangentially of the housing 4 of pump 3 with the housing 4 comprising two covers 41, 42. The drive shaft 9 passes into housing 4 through cover 41 and the impeller disc or wheel 7 is fixed to the drive shaft 9 by means of a screw 17. The impeller disc or wheel 7 also has a hub 18 which extends about the shaft 9 and which, by means of a seal generally designated by the reference numeral 19 makes the pump space airtight at the driving side thereof. The impeller wheel or disc 7 has an axial suction space 11, into which the feed tube 5 extends with the tube 5 passing through the housing cover 42. The impeller disc or wheel 7 of the pump 3 is made airtight in relation to the other housing cover 42 by a seal 20. The suction space 11 is connected to the gas cushion of the vacuum enclosure, not shown in FIG. 2, by means of the connector 16.

Figure 3:
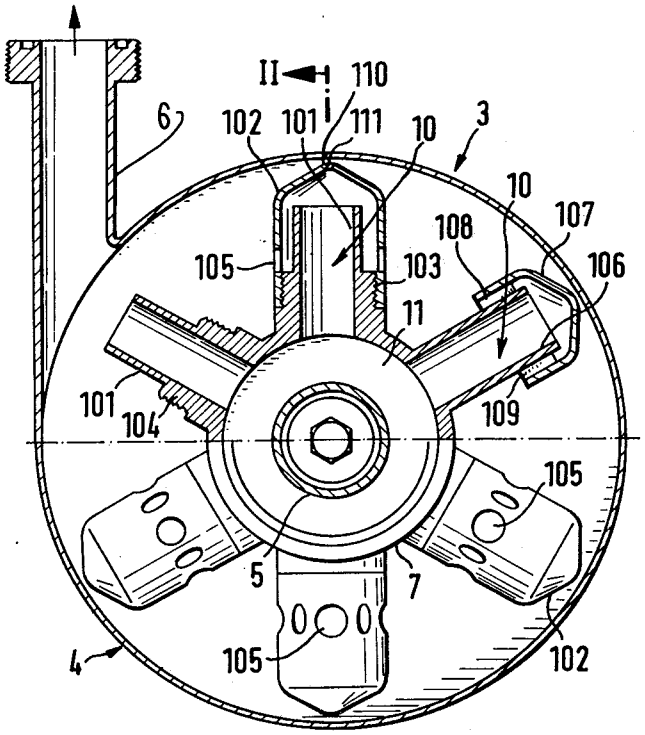
FIG. 3 is a section taken on line III—III of FIG. 2.

In the example illustrated, the impeller disc or wheel 7 has six regularly spaced transport channels 10 extending from the periphery thereof, there being two different forms of the invention shown in FIG. 3. In one form each transport channel 10 includes a tubular section 101 connecting the exterior to the suction space 11, and a cup-shaped cap 102 screwed to a cylindrical extension 104 of the impeller. The cap 102 includes a plurality of exit openings 105 drilled in the wall thereof. If the pump is to be used for the transport of fluids containing solid particles, the cup-shaped part 102, the radial extremity 110 of which rotates near to the wall of the housing 4, is provided with an opening 111 of small clearance, for directing the fluid near the walls of the housing 4″ so that the solid particles leave towards the exterior to be extracted from the outer side of the rotating transport channel 10 via the pressure tube 6.

An alternative form of transport channel 10 is shown in the right hand upper portion of FIG. 3. The impeller disc 7 has a tubular part 106 leading to the exterior, but in this case a cap 107 is mounted on the end of the channel of the tubular part 106 by means of individual distance pieces or spacers 108, so that an exit opening is produced in the form of an open ring 109.

Figure 2:
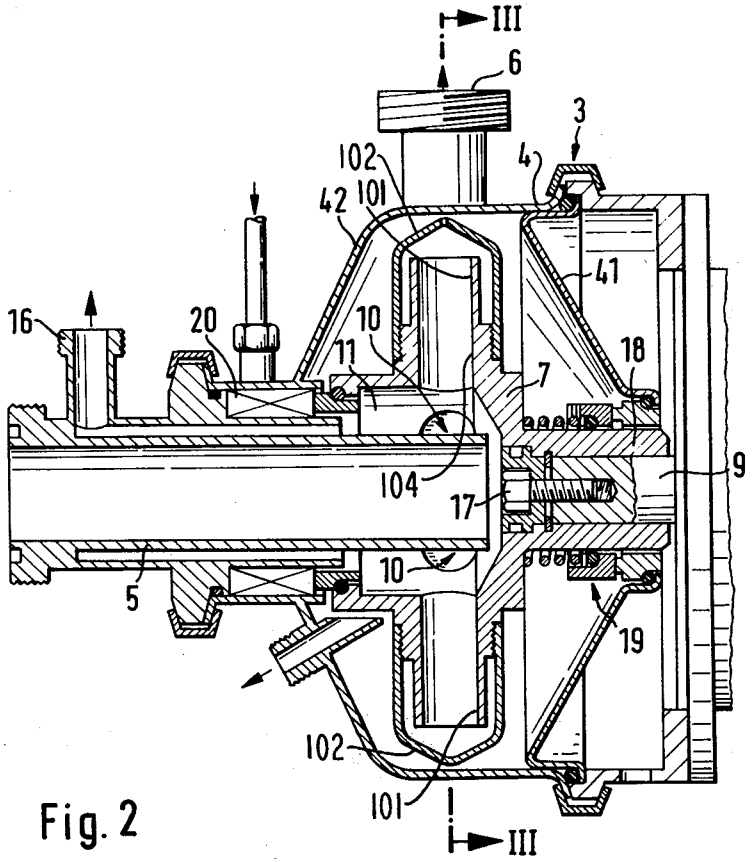
FIG. 2 is an axial section through a preferred form of pump.
Figure 5:
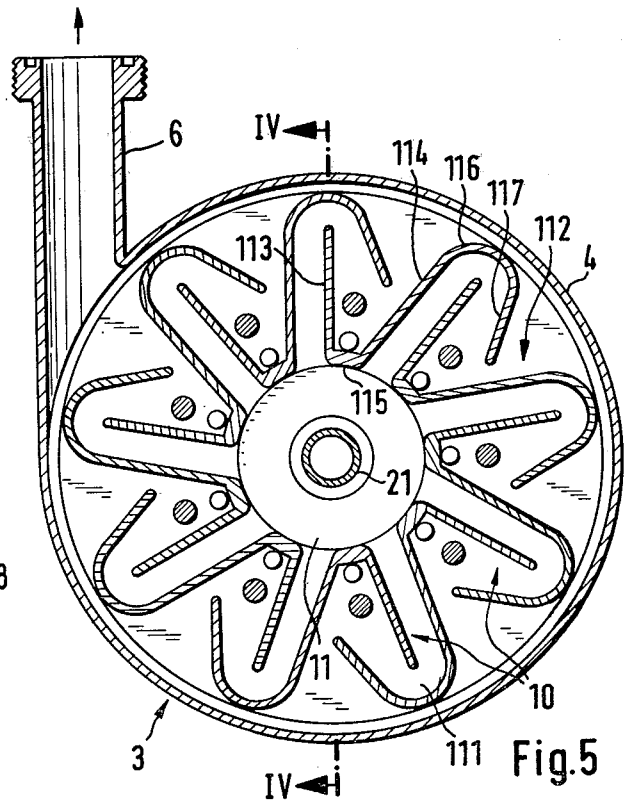
FIG. 5 is a section taken on line V—V of FIG. 4.
Figure 4:
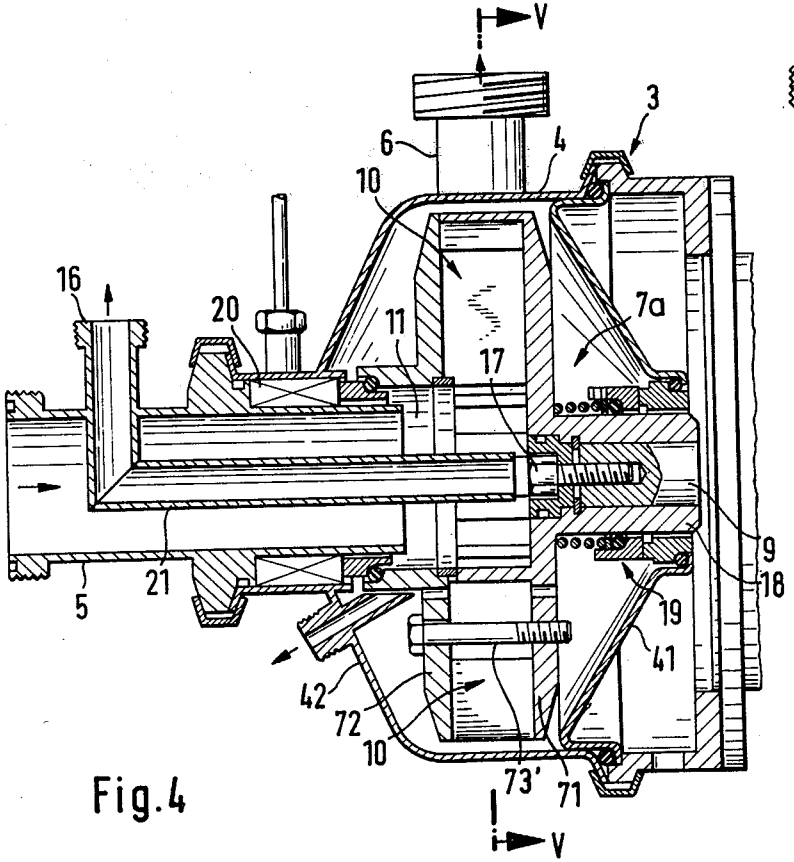
FIG. 4 is an axial section taken on line IV—IV of FIG. 5 of another embodiment of the invention.

In the arrangement shown in FIGS. 4 and 5, the housing 4 is formed in like manner to that of the embodiment shown in FIGS. 2 and 3. The pressure-balancing connector 16 is, however, taken through the feed tube 5 and has an axially extending tubular part 21 which extends to the suction space 11 of the impeller disc or wheel generally designated by the reference numeral 7*a*. In this embodiment an impeller disc or wheel generally designated by the reference numeral 7*a* comprises coaxially arranged discs 71, 72, fixed together by means of screws 73. The discs 71 and 72 are held apart by spacers generally designated by the reference numeral 112, of equal height located on at least one of the discs 71, 72. As shown most clearly in FIG. 5, the spacers 112 have a wave-shaped profile which includes two straight sections 113, 114, the radially inner ends of which are joined by a connecting piece 115 and a curved section 116 having an inwardly turned end 117.

The transport channels 10 are of rectangular cross-section, and are formed by and between the spacers and the opposed faces of the two discs 71, 72. The fluid can leave between the inwardly turned end 117 and the adjacent radial section 113. The wave-shaped spacers may either be provided between the two discs 71, 72 as profile sections, or may be cast as part of the front face of one of the discs 71, 72.

Figure 6:
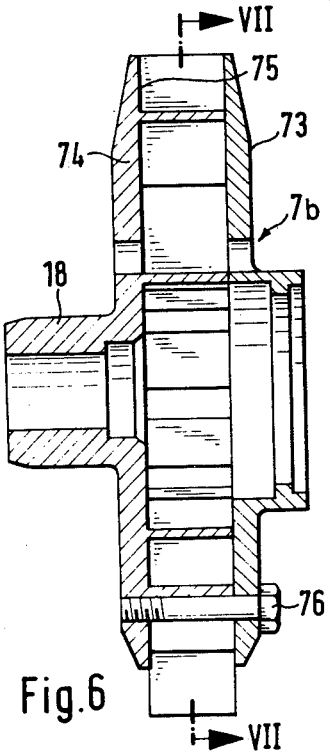
FIG. 6 is an axial section through a third embodiment of the invention.
Figure 7:
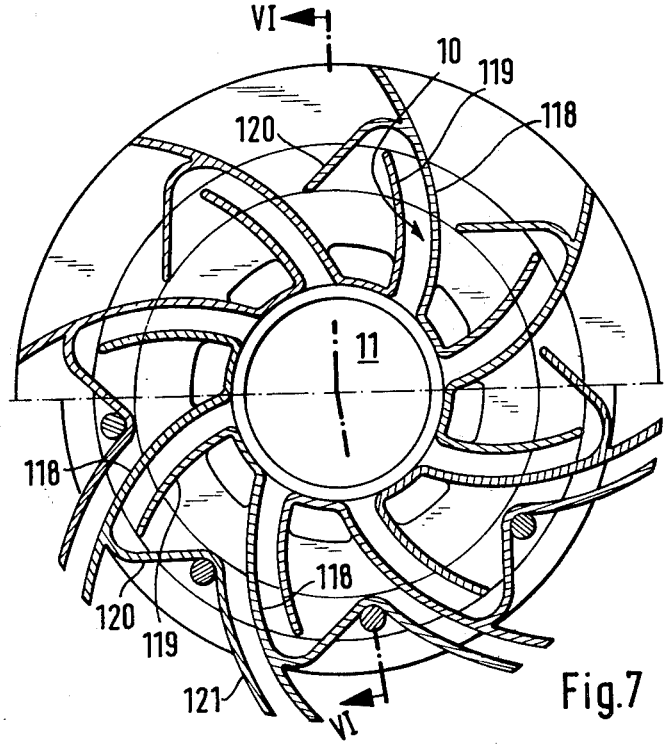
FIG. 7 is a radial section taken on a line corresponding to line VII—VII of FIG. 6, the upper and lower halves of the drawings showing different forms of the invention.

Two similar embodiments are shown in FIGS. 6 and 7. In this case also an impeller generally designated by the reference numeral *7b* is provided which includes two coaxially arranged discs 73, 74 with the transport channels 10 being formed by spacers, of equal height cast into the front surface 75 of one disc 74. As shown in the upper part of FIG. 7, the spacers each comprise a curved section 118, extending from the suction space 11 to the outer periphery of the disc 74, and a shorter section 119 arranged in spaced parallel disposition relative thereto, there being a vertex 120 extending from curved section 118 to overlie the end of the channel in spaced disposition relative thereto and which extends peripherally and radially inwardly of the disc 74. In the modification shown in the lower part of FIG. 7 part 120 is bent again to form an outwardly extending section 121 arranged in spaced parallel relationship with respect to the end of section 118 so that an exit channel is formed between the two curved sections 118 and 121. The two discs 73, 74 are again connected by means of screws 76.

Figure 8:
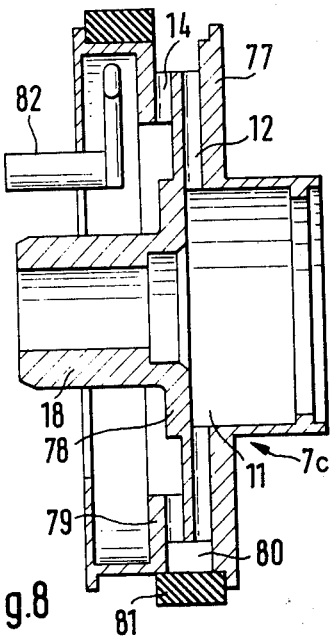
FIG. 8 is an axial section through an embodiment having an openable peripheral closure.

FIG. 8 shows another embodiment of the present invention in which an impeller generally designated by the reference numeral *7c* is provided which comprises three disc-shaped parts 77, 78, 79. The section 12 of the transport channels leading from suction or feed space 11 to the exterior is formed, between one of the discs 77 and a middle disc 78 while the other section 14 of the transport channels is formed between the other outer disc 79 and the middle disc 78. The middle disc 78 is of smaller diameter than the two outer discs 77, 79, with the consequence than an overflow channel 80 for controlling a direction of flow of the fluid, separated from the pump enclosure by an adjustable ring 81 is formed at the periphery. This ring 81 can, as shown at the upper part of FIG. 8, be pushed onto the outer disc 79, so that the overflow channel is open to the outside and any solid matter collecting therein can leave the system. In this embodiment extraction of materials collecting in the disc 79 is carried out through a draw tube 82.

Figure 9:
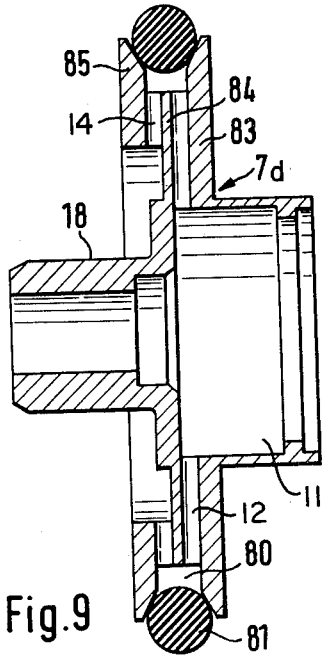
FIG. 9 shows a modification of the arrangement shown in FIG. 8.

The embodiment of the invention shown in FIG. 9 also comprises an impeller generally designated by the reference numeral *7d* made up from three coaxially disposed discs 83, 84, 85, which are, in general, constructed in a similar manner to those of the embodiment shown in FIG. 8. The section 12 of the transport channels leading from the suction or feed space 11 to the exterior is formed between one of the discs 83 and a middle disc 84 while the other section 14 of the transport channels is formed between the outer disc 85 and the middle disc 84. In this embodiment a form of elastic O-ring 81 serves as a closure for the perimeter side of the overflow channel 80 with the O-ring 81 being positioned so as to form a seal on the rolling wheel discs at the appropriate place. The elasticity of the O-ring 81 can be so selected that, at a determined pressure increase in the transport channel the O-ring 81 is lifted, so that solid particles can leave the over-flow channel 80 thereby providing a self-cleaning effect.

What is claimed is:

1. A pump for extracting fluids from a vacuum enclosure into an enclosure at a higher pressure, the pump comprising a pump housing, a pressure tube extending substantially tangential to the pump housing, an impeller means rotatably mounted relative to parts of the pump housing a feed means for axially delivering a fluid to the impeller means, and fluid transporting means on the impeller means for transporting fluid from the feed means to the pressure tube, characterized in that the impeller means includes a suction space, the fluid transporting means includes transport channel means in communication with the suction space for leading fluid from the suction space to the pressure tube, said transport channel means being constructed so that fluid is led outwardly from the suction space and then inwardly relative to the impeller means to the pressure tube, means are provided for communicating the suction space of the impeller means with the vacuum enclosure, and in that means are provided for sealing the suction space with respect to non-rotating parts of the pump housing.

2. A pump as claimed in claim 1, characterized in that the suction space defines an axially disposed volume and in that the feed means of the pump are introduced axially into the suction space.

3. A pump as claimed in claim 1, characterized in that the transport channel means includes a first tubular section extending approximately radially with respect to the impeller means, and a second cup-shaped section overlying said first section.

4. A pump as claimed in claim 1, characterized in that the transport channel means include a bent section extending opposite to a direction of rotation of the impeller means.

5. A pump as claimed in claim 1, characterized in that the impeller means comprises two coaxially arranged interconnected discs having opposed surfaces, the transport channel means includes spacers of equal height provided on an opposed surface of at least one of the two discs, each of said spacers including a first section leading radially outward relative to the discs and a second section leading inward relative to the discs, and in that the opposed surfaces of the discs form transport channel means of a substantially rectangular cross-section.

6. A pump as claimed in claim 5, characterized in that the spacers form a vertex bent in the shape of an arc near an outer periphery of the discs for reversing a direction of flow of the fluid.

7. A pump as claimed in claim 1, characterized in that at least one small clearance opening is provided at a radial extremity of the transport channel means for diverting the fluid close to walls of the pump housing.

8. A pump as claimed in claim 1, characterized in that the impeller means comprises three coaxially arranged interconnected discs with one of the discs being arranged between the other two discs, said one of the discs having a smaller diameter than the other two discs so as to form an overflow channel means for controlling a direction of flow of the fluid, and in that said transport channel means includes spacer means disposed between the respective discs for maintaining the discs in a spaced relationship and for defining the transport channel means.

9. A pump as claimed in claim 8, characterized in that a detachable ring means is arranged between said other two outer discs for providing an airtight seal for the overflow channel means.

10. A pump as claimed in claim 9, characterized in that the ring means is constructed of an elastic material so as to be automatically displaceable from a sealing position when a pressure in the overflow channel means reaches a predetermined value.

11. A pump as claimed in claim 1, characterized in that the transport channel means includes a plurality of tubular sections extending radially outwardly from a periphery of the impeller means with each of said tubular sections being in communication with the suction space, and in that a cup-shaped cap is disposed at free ends of each of said tubular sections.

12. A pump as claimed in claim 11, characterized in that a plurality of spacer means are provided for mounting the cup-shaped cap at each of the tubular sections.

13. A pump as claimed in claim 1, characterized in that the transport channel means includes a plurality of spacer means for defining a plurality of individual fluid transporting channels, each spacer means includes two radially outwardly extending straight sections joined by a connecting piece at radially inner ends thereof and a curved section having a radially inturned end.

14. A pump as claimed in claim 1, characterized in that the impeller means comprises two coaxially arranged interconnected discs having opposed surfaces, the transport channel means includes a plurality of spacer means mounted on at least one of the opposed surfaces of the two discs for defining a plurality of individual fluid transport channels, and in that each of the spacer means includes a curved section extending from the suction space to an outer periphery of the discs, a short section arranged in spaced parallel disposition to the curved section, and a further section extending from the curved section so as to overlie an end of the fluid transporting channel, said further section extends peripherally and radially inwardly of the discs.

15. A pump as claimed in claim 14, characterized in that each of the spacer means further includes a bent section provided at the further section, said bent section being arranged in a spaced parallel relationship to said curved section.

* * * * *